United States Patent [19]

Bardoff

[11] Patent Number: 4,864,970

[45] Date of Patent: Sep. 12, 1989

[54] CLEAN STEAM GENERATOR AND METHOD

[75] Inventor: Samuel B. Bardoff, Owings Mills, Md.

[73] Assignee: GEA Food and Process Systems Corp., Columbia, Md.

[21] Appl. No.: 260,475

[22] Filed: Oct. 20, 1988

[51] Int. Cl.[4] ..... F22B 1/02

[52] U.S. Cl. ..... 122/32; 122/35; 122/441

[58] Field of Search ..... 122/33, 35, 422, 441, 122/32, 4 R; 60/641.1, 641.2; 165/47 BW; 126/369

[56] References Cited

U.S. PATENT DOCUMENTS

| | | | |
|---|---|---|---|
| 684,770 | 10/1901 | Patterson | 122/441 |
| 4,091,623 | 5/1978 | Edmundson et al. | 60/641.2 |
| 4,228,657 | 10/1980 | Leo | 60/641.2 |
| 4,565,161 | 1/1986 | Choquette | 122/32 |
| 4,712,380 | 12/1987 | Smith | 60/641.2 |

*Primary Examiner*—Edward G. Favors

*Attorney, Agent, or Firm*—Watson, Cole, Grindle & Watson

[57] ABSTRACT

A process and apparatus for producing clean steam by placing impure steam in heat exchange relationship with clean water but physically separated therefrom to produce superheated clean water and vapor, and permitting expansion of the fluids to form clean steam and recyclable hot water.

20 Claims, 1 Drawing Sheet

CLEAN STEAM GENERATOR AND METHOD

Figure 1:
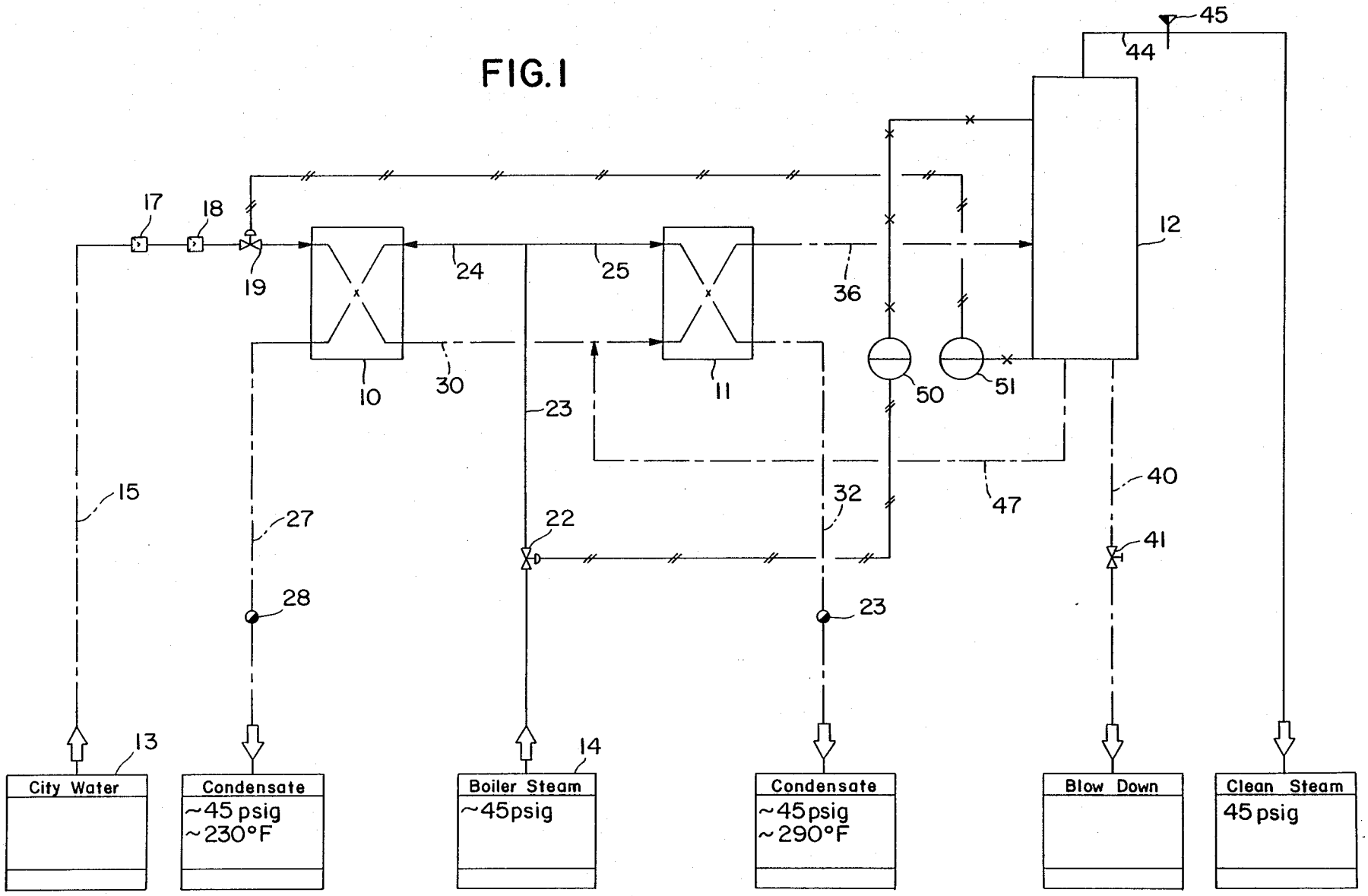

The field of the present invention relates to the generation of steam, i.e., the application of heat to water to cause the water to pass from liquid to vapor phase. In particular, the field of this invention is the generation of steam from water by the application of heat from steam to the cold water.

In many fields, and particularly in the processing of foods and containers for food, there is need for generating steam having a low level of impurities. For example, such steam, which may be termed "clean steam," is necessary in the brewery industry. Where kegs of beer have been emptied and are to be refilled, they must first be cleaned and sterilized. While boiler steam may be readily available for such cleaning and sterilization, certain contaminants are often added to boiler water used to generate the steam. One contaminant that is often added to boiler water to prevent corrosion or scaling is chromate; yet it will be apparent that steam to which chromates have been added should not be used for food purposes. Thus, boiler water which is normally subjected to chemical treatment cannot be used for sterilizing beer kegs, which are to be sterilized and then refilled.

As a consequence, it is a primary object of the present invention to make use of the heat of readily available boiler steam for cleaning containers and other vessels, despite the presence of contaminants in the boiler steam. It is a more specific object of this invention to utilize the heat of boiler steam in order to create steam from clean water, so that the resulting clean steam may readily be utilized for applications in which a low level of undersirable contaminants is requisite, e.g., for sterilizing brewery kegs prior to refilling them with beer.

SUMMARY OF THE INVENTION

The present invention takes the form of both a method and an apparatus. In method form, the invention comprises steps of providing clean water having a low level of undesirable impurities, and providing impure steam, which has an undesirable level of such impurities. The clean water and impure steam are brought into a heat exchange relationship in which, while they are maintained physically separate, heat from the steam is transferred to the clean water to form both water vapor (clean steam) and superheated clean water. Thereafter, at least a portion of the pressure on the superheated water is released to produce clean hot water and clean steam, after which the clean steam is collected for use in applications requiring steam having a low level of undesirable impurities.

In more detail, the present method further comprises adjusting the flow of the impure steam into heat exchange relationship in accordance with the amount of clean steam produced, and such adjustment is normally automatic. Also, the flow of clean water into the heat exchange relationship may be governed by the amount of clean hot water produced, and such adjustment is also normally automatic.

Another embodiment of the present invention in method form involves bringing the clean water and impure steam into a first heat exchange relationship in which they are maintained physically separated to transfer heat from the impure steam to the clean water to form hot clean water. Thereafter, the clean hot water is brought into a second heat exchange relationship with the impure steam, the result of such second relationship being the production of clean water, vapor and clean water superheated to a temperature above its boiling point. Thereafter, some of the pressure on the superheated water is released to produce clean hot water, generally boiling water, and clean steam.

In apparatus form, the present invention embodies first and second heat exchangers in which heat is transferred from one fluid to another without physical contact between the fluids. There is means for providing relatively clean water to the first heat exchanger, as well as relatively impure steam, so that clean hot water is produced. There is also means for transporting the clean hot water from the first to the second heat exchanger. According to conditions within the accumulator, a portion of the hot water is evaporated and the remaining hot water is superheated. An accumulator permits expansion of the superheated clean hot water to form steam and hot boiling water.

In other aspects the apparatus form of the invention includes means for transporting the boiling clean water from the accumulator to the second heat exchanger, or to the means for transporting the clean hot water from the first to the second heat exchanger, in which transporting means the boiling water is combined with the clean hot water. In order to render the apparatus automatic, the flow of clean water into the first heat exchanger is governed by adjusting means operable in accordance with the accumulation of boiling water in the accumulator, i.e., as the level of boiling water in the accumulator falls, the adjusting means increases the flow of water into the first heat exchanger; as the level of water in the accumulator rises, the adjusting means decreases the flow of water into the first heat exchanger. In a like manner, the amount of impure steam entering the first heat exchanger is varied by an adjusting means, as is the amount of impure steam that enters the second heat exchanger. Such adjusting means operates to increase the amount of steam that enters the first and second heat exchangers with a decrease in the pressure of clean steam in the accumulator, and vice versa. In still another aspect of the invention, the heat exchangers of the apparatus are preferably plate heat exchangers.

These and other objects, features, and advantages of the invention will become more apparent when considered in conjunction with a preferred embodiment of the invention as described hereinafter and as illustrated in the accompanying drawing, in which the sole figure is a flow diagram of what is presently considered to be the best mode of the invention.

Referring now to FIG. 1 of the drawing and the flow diagram embodied therein, primary parts of the apparatus of the invention are plate heat exchangers 10 and 11, and an accumulator 12. The heat exchangers 10 and 11 are each preferably plate heat exchangers of the type sold by GEA Ahlborn, of Sarstedt, West Germany, with a U.S. office in Columbia, Md. These plate heat exchangers are of a construction such that while they permit the transfer of heat between two fluids, such transfer is affected without physical contact between the fluids. The accumulator 12 is what might also be termed an expansion chamber in which fluids under pressure are permitted to expand under reduced pressure. In order for this fully automatic system to become operable, there must be a source of relatively clean water, which source is here designated as city water 13, and a source of boiler steam, which is here designated by reference numeral 14.

To describe the system by the flow diagram, city water is supplied under pressure from its source 13 to a prefilter 17, which removes solid contaminants from the water, before delivering the flow to carbon filter 18. The carbon filter incorporates an activated carbon bed which removes fluids of high vapor pressures that give the water being processed an odor or taste. Flow of the clean water from the carbon filter 18 to heat exchanger 10 is controlled by valve 19, and such water flows into plate heat exchanger 10 and into heat transfer relationship with boiler steam from its source 14.

As shown in the flow diagram, boiler steam, which is relatively impure compared to the relatively clean water issuing from carbon filter 18, moves past valve 22 in a line 23 that diverges into line segments 24 and 25. As will be apparent, where the boiler steam passes through line 23 and line segment 24, it will be directed to heat exchanger 10 to heat the clean water issuing from valve 19. Having been relieved of much of its heat, the condensate from boiler steam that passes through heat exchanger 24 will be collected in line 27, past condensate trap 28 into a disposal tank or other repository for this waste water, which will still contain some impurities and contaminants that make it undesirable for use in cleaning food vessels.

After passing through the heat exchanger 10, hot water from line 15 exits heat exchanger 10 through line 30 and is directed by that line to second plate heat exchanger 11. In the second plate heat exchanger the hot water, which is relatively clean compared to the level of impurities in the dirty boiler steam, is further heated by boiler steam from line segment 25. When the boiler steam has performed its heating function, in a manner similar to that issuing from heat exchanger 10, spent steam from heat exchanger 11 passes through exit line 32 past condensate trap 33 into a disposal outlet.

In heat exchanger 11, a portion of hot water in line 30 is evaporated and the remainder of the hot water in line 30 is raised to a temperature slightly above the saturation temperature of steam corresponding to pressure of steam in the accumulator 12. As a result, superheated vapor and liquid are formed within heat exchanger 11 corresponding to conditions in the accumulator 12. This superheated temperature is achieved as a result of the boiling liquid level in the accumulator 12 being above the level in heat exchanger 11, thereby establishing a slight back pressure on that plate heat exchanger assembly. As the slightly superheated water and vapor pass through line 36 and enters the accumulator, an adiabatic flash of the superheated liquid occurs, producing saturated steam and boiling water, and the vapor expands to the pressure within the accumulator. As a consequence, in the accumulator 12 there will be clean steam and clean boiling water. The clean steam is removed from the accumulator through line 44. To minimize the concentration of dissolved contaminants (not removed by filters 17 or 18) in the boiling liquid within accumulator 12, "blow down" or a small liquid flow from the accumulator to a disposal outlet is maintained. This "blow down" passes through line 40 and regulating valve 41.

The final fluid that exits from accumulator 12 is boiling clean water, which was separated from the clean steam in the accumulator. This boiling water is advantageously directed through line 47 to a junction with line 30, and is allowed to mix with the hot water issuing from heat exchanger 10. The mixture is fed into second heat exchanger 11.

In order to maintain the entire system automatically operable, controls are provided for adjusting the amount of water that enters the heat exchanger 10, as well as the amount of boiler steam that enters the first heat exchanger 10 and the second heat exchanger 11. Thus, the pressure of clean steam in the accumulator is sensed by a pressure control system 50. As the pressure within accumulator 12 falls, pressure control system 50 will allow more boiler steam to enter the heating sides of the heat exchangers 10 and 11 by increasing the flow of boiler steam through valve 22. As the flow of clean steam in the accumulator rises above the demand rate, and pressure builds within the accumulator, pressure control system 50 operates control valve 22 to limit the amount of boiler steam passing through the line 23, where upon less heating occurs and the pressure of clean steam within the accumulator 12 will fall.

In a similar manner, sensing the level of boiling water within accumulator 12, level control system 51, through control valve 19, gates the amount of clean city water that will enter the first heat exchanger 10. Level control system 51 operates so that as the level of boiling water within accumulator 12 falls, the flow of water through control valve 19 feeding heat exchanger 10 is increased. When the level of boiling water within accumulator 12 rises, the flow of clean water is decreased.

Mechanically, each plate heat exchanger 10 and 11 consists of a frame which holds heat transfer plates in a vertical plane, one stationary end plate, one grid plate to physically separate the components of plate heat exchanges, and a follower or movable end plate. The end plates compress the heat transfer plates, which are tied together by tie rods or a spindle mounted on the frame. The frame incorporates a carrying bar and a guide bar which support the plates. Gaskets are installed between adjacent plates, and mechanically fastened or glued onto the back of each plate. This results in two plate packs that form a system of parallel panels where the fluids flow alternatively through every second plate interval. In operation, boiler steam is condensing on one side of the plates boiler steam is condensing, and on the other side of the plates filtered city water is being heated. All process flow connections (boiler steam condensate outlet, city water inlet, and hot filtered city water outlet) are located on the unit's stationary end plate, grid plate, or follower.

Heat transfer through the plates of the heat exchangers result from the temperature boiler steam on the hot side of each plate being higher than the temperature of filtered city water on the cold side of each plate. This temperature differential is the driving force for heat transfer. At 45 psig pressure within accumulator 12, it has been found in practice that heat exchanger 10 discharges clean hot water at about 200° F. A trap removes boiler steam condensate. Since there is some subcooling of the boiler steam condensate within the heat exchanger, the condensate flow temperature is less than the boiler steam saturation temperature.

From the method and apparatus described hereinbefore, it will be seen that the best mode of the invention comprises an apparatus and method whereby city water and impure, boiler steam will be input, and the output will be condensates and, more importantly, clean steam, i.e., steam which does not contain the impurities in the boiler steam that has been utilized to produce the clean steam. Once the lines have been connected, the system will be self-regulating, such regulation being valved by means of the level control system 51 and steam pressure control system 50. Because of the use of heat exchangers that prevent physical contact between the boiler steam and the city water, contaminants in the boiler steam do not pass into the city water, but remain in the boiler steam and, eventually, in the condensate from the boiler steam. The useful product from the entire process is the clean steam, which is suitable for many purposes, including cleaning containers, such as beer kegs, which will be refilled and must be sterilized prior thereto with steam that will not add contaminants during sterilization.

It will be apparent to those of skill in this art that there will be alterations and modifications of the best modes of the method and apparatus inventions, which have been illustrated and described hereinbefore with reference to FIG. 1 of the drawings. As to all such obvious alterations and modifications, it is desired that they be included within the purview of the invention, which is to be limited only by the scope, including equivalents, of the following, appended claims.

What is claimed is:

1. A method of utilizing the heat of relatively impure steam to form relatively clean steam from clean water, comprising:

(a) providing relatively clean water having a low level of undesirable impurities;

(b) providing relatively impure steam having a level or kind of impurities that limits the use of said steam;

(c) bringing said clean water and said impure steam into a heat exchange relationship in which said water and said steam are maintained physically separated;

(d) therein transferring heat from said impure steam to said clean water to form, under pressure, clean water vapor and clean water superheated above its boiling point;

(e) releasing at least a portion of the pressure on said superheated water and vapor to produce clean hot water and clean steam, and (f) collecting said clean steam for use in applications requiring steam having a low level of undesirable impurities.

2. A method of utilizing the heat of relatively impure steam to form relatively clean steam from clean water as claimed in claim 1, further comprising adjusting the flow of impure steam into said heat exchange relationship in accordance with the amount of clean steam produced.

3. A method as claimed in claim 2, in which said adjustment is automatic.

4. A method as claimed in claim 1, further comprising adjusting the flow of clean water into said heat exchange relationship in accordance with the amount of clean hot water produced.

5. A method as claimed in claim 4, in which said adjustment is automatic.

6. A method as claimed in claim 3, further comprising automatically adjusting the flow of clean water into said heat exchange relationship in accordance with the amount of clean hot water produced.

7. A method of utilizing the heat of relatively impure steam to form relatively clean steam from clean water, comprising:

(a) providing relatively clean water having a low level of undesirable impurities;

(b) providing relatively impure steam having a level or kind of impurities that limits the use of said steam;

(c) bringing said clean water and said impure steam into a first heat exchange relationship in which said water and said steam are maintained physically separated;

(d) therein transferring heat from said impure steam to said clean water to form hot clean water;

(e) bringing said hot, clean water into a second heat exchange relationship with said impure steam while maintaining said hot water and said steam physically separated to form, under pressure, a mixture of clean water vapor and clean water superheated above its boiling point;

(f) releasing at least a portion of the pressure on said superheated water to produce clean hot water and clean steam, and (g) collecting said clean steam for use in applications requiring steam having a low level of undesirable impurities.

8. A method of utilizing the heat of relatively impure steam to form relatively clean steam from clean water as claimed in claim 7, in which said clean hot water produced is boiling hot water.

9. Apparatus for utilizing the heat of relatively impure steam to form relatively clean steam from clean water, comprising:

(a) a first heat exchanger constructed to transfer heat from one fluid to another without physical contact between the fluids, (b) means for providing relatively clean water to said first heat exchanger;

(c) means for providing relatively impure steam to said first heat exchanger, so that heat from said steam is transferred to said water to form hot water;

(d) a second heat exchanger constructed to transfer heat from one fluid to another without physical contact between the fluids;

(e) means for transporting said hot clean water from said first heat exchanger to said second heat exchanger;

(f) means for supplying relatively impure steam to said second heat exchanger, so that the heat from said steam is transferred to said hot clean water to superheat said water and form water vapor;

(g) an accumulator to permit expansion of superheated fluids;

(h) means for transporting said water vapor and superheated clean water from said second heat exchanger to said accumulator, so that said superheated fluids form steam and boiling hot water in said accumulator, and (i) means for conducting said clean steam from said accumulator to a location at which said clean steam can be utilized.

10. Apparatus for forming clean steam from relatively clean water and relatively impure steam as claimed in claim 9, further comprising means for transporting said boiling water from said accumulator to said second heat exchanger.

11. Apparatus as claimed in claim 9, further comprising means for transporting boiling water from said accumulator to said means for supplying said hot clean water from said first heat exchanger to said second heat exchanger, in which said transported boiling water is combined with said hot clean water.

12. Apparatus as claimed in claim 9, in which said means for providing relatively clean water to said first heat exchanger includes means for filtering water.

13. Apparatus as claimed in claim 9, further comprising means for adjusting the flow of water through said means for supplying relatively clean water to said first heat exchanger, said adjusting means being actuated in accordance with the accumulation of boiling water in said accumulator.

14. Apparatus as claimed in claim 13, in which said adjusting means increases the flow of water to said first heat exchanger as the level of water in said accumulator falls, and decreases the flow of water to said first heat exchanger as the level of water in said accumulator rises.

15. Apparatus as claimed in claim 9, further comprising means for adjusting the amount of steam that enters said first heat exchanger in accordance with the pressure of clean steam in said accumulator.

16. Apparatus as claimed in claim 9, further comprising means for adjusting the amount of steam that enters said second heat exchanger in accordance with the pressure of clean steam in said accumulator.

17. Apparatus as claimed in claim 9, further comprising means for adjusting the amount of steam that enters said first and second heat exchangers in accordance with the pressure of clean steam in said accumulator.

18. Apparatus as claimed in claim 9, further comprising means for adjusting the flow of relatively impure steam through said means for supplying said steam to said first and second heat exchangers, said adjusting means increasing the flow of said impure steam as the pressure of clean steam in said accumulator decreases and decreasing the flow of impure steam as the pressure of clean steam in said accumulator increases.

19. Apparatus as claimed in claim 9, in which said first heat exchanger is a plate heat exchanger.

20. Apparatus as claimed in claim 9, in which said second heat exchanger is a plate heat exchanger.

* * * * *